United States Patent [19]

Kladitis

[11] Patent Number: 4,567,962

[45] Date of Patent: Feb. 4, 1986

[54] PERSONAL LOWERING DEVICE

[76] Inventor: Nicholas S. Kladitis, 1636 Ridge Ave., Sharpsville, Pa. 16150

[21] Appl. No.: 574,335

[22] Filed: Jan. 27, 1984

[51] Int. Cl.[4] ..... A62B 1/08

[52] U.S. Cl. ..... 182/5; 182/192; 182/240

[58] Field of Search ..... 182/5, 3, 4, 6, 7, 191–193, 182/231, 234, 236, 239, 240, 71; 188/65.1–65.4

[56] References Cited

U.S. PATENT DOCUMENTS

| | | | |
|---|---|---|---|
| 311,039 | 1/1885 | Scheidt | 185/5 |
| 370,612 | 9/1887 | Fellows | 182/73 |
| 461,528 | 10/1891 | Fowler | 182/193 |
| 4,054,183 | 10/1977 | Boniface | 182/7 |

FOREIGN PATENT DOCUMENTS

| | | | |
|---|---|---|---|
| 018302 | 10/1980 | European Pat. Off. | 182/5 |
| 1048303 | 11/1966 | United Kingdom | 182/5 |
| 2103560 | 2/1983 | United Kingdom | 182/7 |

*Primary Examiner*—Reinaldo P. Machado
*Assistant Examiner*—Alvin Chin-Shue
*Attorney, Agent, or Firm*—Robert D. Yeager; Christine R. Ethridge

[57] ABSTRACT

A personal lowering device having two lines, a housing through which the lines so move that the housing descends along the lines when the lines are suspended from an elevated position, a sheave assembly and two brakes disposed within the housing, and two pairs of cinching sheaves biased toward a position for reducing the flow of the lines into the housing. The brakes are so associated with the sheave assembly and the housing that a slight biasing force on the two pairs of cinching sheaves reduces the flow of line into the housing, forcing the sheave assembly into pivoting motion, thereby forcing the brakes against the housing and thus halting the descent of the housing along the lines. A control member is provided for moving the cinching sheave pairs away from the reducing position.

18 Claims, 5 Drawing Figures

Fig. 3.
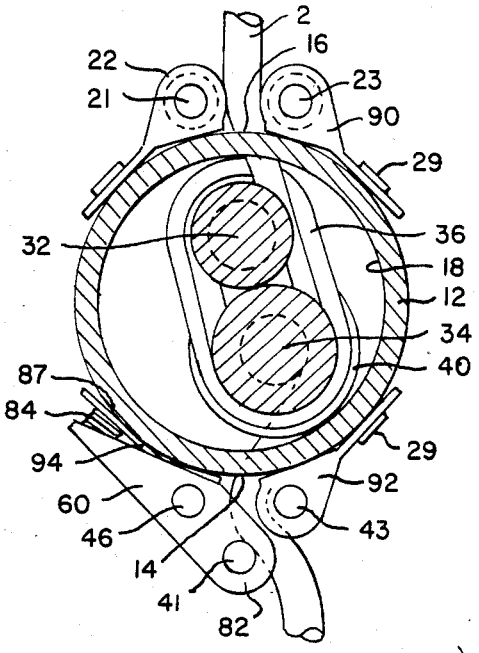
Fig. 4.
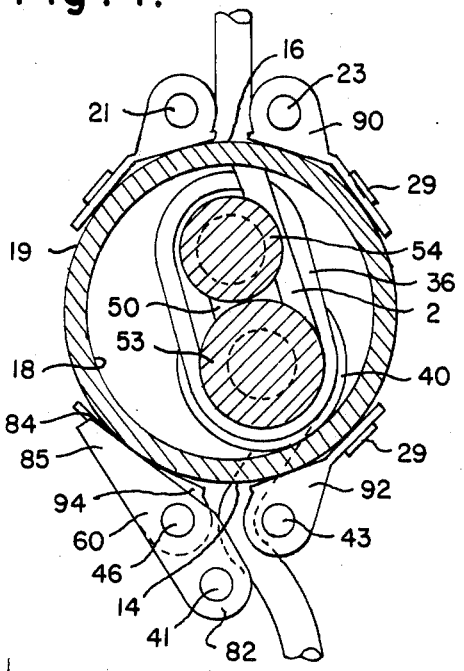
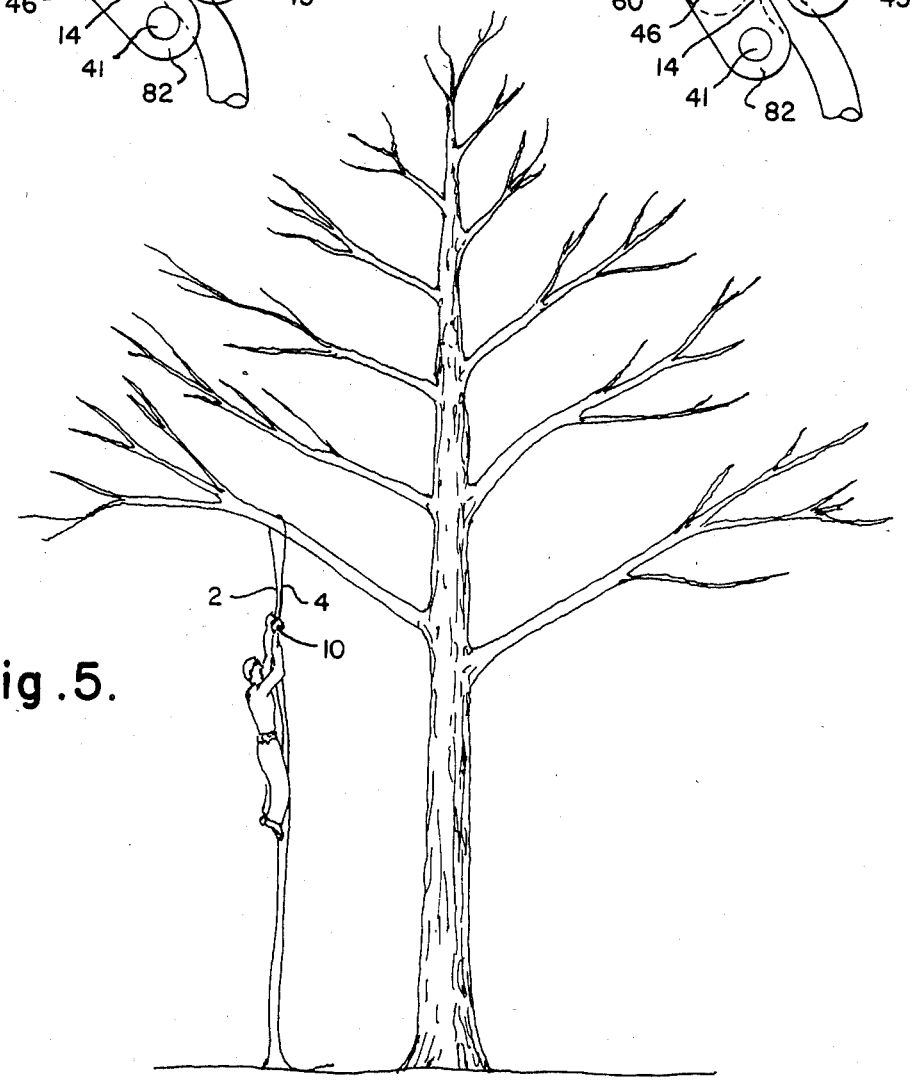
Fig. 5.

PERSONAL LOWERING DEVICE

BACKGROUND OF THE INVENTION

1. Field of the Invention

The present invention relates to personal lowering devices, more particularly to lightweight portable devices having brakes for controlled descent.

2. Description of the Prior Art

Various systems have been developed for lowering persons from elevated positions in emergency situations. Fire escapes are disclosed by U.S. Pat. No. 311,039, U.S. Pat. No. 461,528, U.S. Pat. No. 1,229,394 and U.S. Pat. No. 4,063,615. Lowering devices for military use, particularly air force use, are disclosed by U.S. Pat. No. 3,159,241, U.S. Pat. No. 3,419,236 and U.S. Pat. No. 3,159,241.

Conventional devices employ rollers, pulleys, sheaves and friction brake mechanisms, often enclosed within a housing through which a rope passes. The brakes directly restrict the rope flow to control the rate of descent. The rope, therefore, is subject to stress and rapid wear. The conventional devices are bulky and uncomfortable. Those designed for military use are often suitable for use with only particular types of aircraft.

Accordingly, there is a need for a personal lowering device which is compact and lightweight so that it may be included in the personal equipment or parachute pack of an airman. There is a further need for such a device which will be usable in a variety of weather and operational conditions. Such a device should be simple to operate, requiring slight force to control the rate of descent, and durable, having parts which will resist wear.

SUMMARY OF THE INVENTION

The present invention provides a personal lowering device which responds to the gravitational pull exerted by a weight placed thereon for use with at least one, but preferably two lines suspended from an elevated position which includes a housing adapted to permit the line to so flow therethrough that the housing can descend along the line, means disposed within the housing for receiving and tensioning the line as the line flows through the housing, the receiving and tensioning means adapted to rotate in response to the flow of the line and adapted to pivot in response to the pull of the weight, and at least one brake so associated with the receiving and tensioning means that the pivot of said receiving and tensioning means imparts a moment to the brake and the rotation of said receiving and tensioning means imparts a torque to the brake. The housing is configured for such interaction with the brake and the housing can hold the moment to a predetermined magnitude and the torque can so counteract the moment that the housing descends when the torque is substantially equal to or greater than the moment and stops when the torque is less than the moment. The device may also include means biased toward a position for reducing the torque relative to the moment, where the reducing means is adapted for movement away from the reducing position.

The receiving and tensioning means may be a sheave assembly which has at least one, but preferably two, sets of sheaves adapted for so receiving the line that the line spirals around the set imparting rotation to the set as the line flows through the housing. The sheave assembly preferably includes a stationary shaft attached to the housing, a pivoting shaft which is so connected to the stationary shaft that the pivoting shaft lies in a parallel spaced relationship relative to the stationary shaft and is adapted for pivoting motion relative to the stationary shaft, and means, preferably brackets, for connecting the pivoting shaft to the stationary shaft. Each set of sheaves preferably includes a first sheave which is so mounted on the stationary shaft and a second sheave which is so mounted on the pivoting shaft that the set imparts rotation to the stationary and pivoting shafts. The first and second sheaves may each have a plurality of annular grooves, preferably three, in which the line is received. The brake is so mounted on the pivoting shaft that the brake moves with the pivoting shaft.

The device of the present invention may further include means for guiding the line as the line exits the housing, which may be at least one, but preferably two pairs of guide sheaves disposed on the housing. Each pair is adapted for receiving one line as the line exits the housing.

The reducing means may include at least one but preferably two pairs of cinching sheaves disposed on the housing and adapted for receiving one line, at least one spring for biasing the cinching sheave pair in the reducing position, a control member associated with the cinching sheave pair and the spring for moving the cinching sheave pair away from the reducing position, where the reducing position is one in which the cinching sheave pair is positioned for so cinching the line that the rate of flow of the line through the housing is reduced.

BRIEF DESCRIPTION OF THE DRAWINGS

The following detailed description of the preferred embodiment can better be understood if reference is made to the drawings in which:

FIG. 3 is a cross section view showing the cinching sheaves in the reducing position.

FIG. 4 is a cross section view of the devices shown in FIG. 1, showing the cinching sheaves moved away from the reducing position taken along line IV—IV.

FIG. 5 is a perspective view of the device in use.

DETAILED DESCRIPTION OF THE PREFERRED EMBODIMENT

Figure 1:
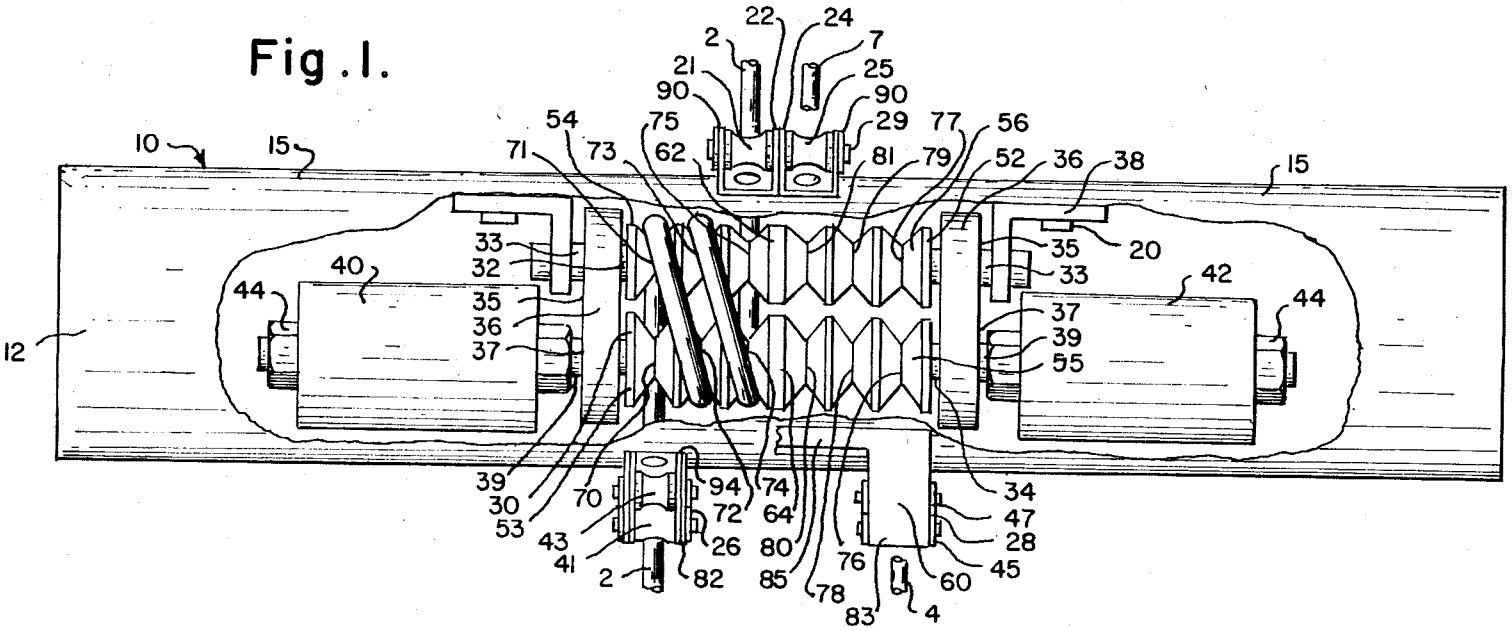
FIG. 1 is a section view of the device showing the line in one portion.
Figure 2:
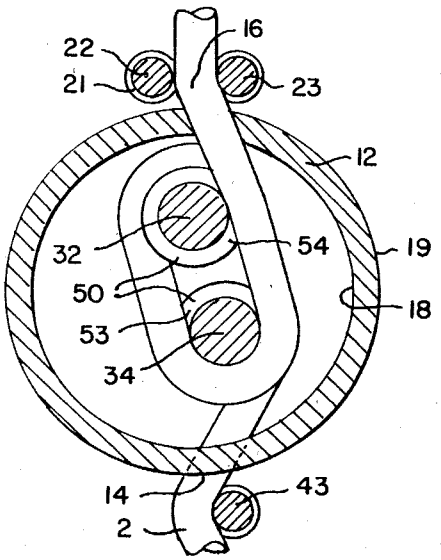
FIG. 2 is a diagrammatic view of a cross section of the device shown in FIG. 1, with a line passing through, taken along line IV—IV.

FIGS. 1 through 5 illustrate the preferred embodiment of the personal lowering device of the present invention.

The device 10 includes housing 12, lines 2 and 4, sheave assembly 30, brakes 40 and 42, guide sheave pairs 22 and 24, and cinching sheave pairs 26 and 28. Housing 12 has ends 15 which are preferably configured for hand grasping by the user, as illustrated in FIG. 5. Lines 2 and 4 move through housing 12 via entrance 14 and exit 16. When lines 2 and 4 are suspended from elevated positions, housing 12 descends along lines 2 and 4. Housing 12 also has interior surface 18 and exterior surface 19.

Guide sheave pair 22 includes guide sheave members 21 and 23 and guide sheave pair 24 includes guide sheave members 25 and 27. They are attached by any suitable known means, preferably rivets 29, to brackets 90 which are attached to the exterior surface 19 of housing 12 adjacent exit 16. Line 2 is positioned between the sheave members 21 and 23 of pair 22 and line 4 is positioned between the sheave members 25 and 27 of pair 24 as illustrated in FIGS. 1, 3 and 4.

Cinching sheave pair 26 includes cinching sheave members 41 and 43 and cinching sheave pair 28 includes cinching sheave members 45 and 47. Cinching sheave members 43 and 47 of pairs 26 and 28, respectively, are attached by any suitable known means, preferably rivets 29, to brackets 92 which are attached to exterior surface 19 of housing 12 adjacent entrance 14.

Cinching sheave member 41 is attached, preferably by rivets 29, to end 82 of control member 60. Tension sheave member 45 is attached in a similar fashion to end 83 of control member 60. Referring to FIGS. 3 and 4, control member 60 is attached to brackets 94 at pivot points 46. Brackets 94 are connected to the exterior surface 19 of housing 12. Control member 60, therefore, pivots about the imaginary line between pivot points 46. Control member 60 has central portion 85 joining ends 82 and 83. Two springs 84 are connected, preferably by rivets 87, to central portion 85 near ends 82 and 83, respectively, and to the exterior surface 19 of housing 12. It will be appreciated, however, that a single spring or any suitable biasing means may be used without exceeding the scope of the present invention.

Line 2 is received by cinching sheave pair 26 and line 4 is received by cinching sheave pair 28. Springs 84 bias control member 60 and cinching sheave members 41 and 45 toward a position in which lines 2 and 4 are pressed between cinching sheave members 41 and 43 and cinching sheave members 45 and 47, respectively, as shown in FIG. 3. In this position, the flow of lines 2 and 4 into housing 12 through entrance 14 is reduced. When springs 84 are compressed, for example by pressing on central portion 85 of control member 60, control member 60 pivots about the line between pivot points 46, releasing lines 2 and 4, as shown in FIG. 4. In the latter position, lines 2 and 4 are free to move at the normal rate of flow into housing 12 through entrance 14.

Although the preferred embodiment provides means for biasing the device toward a position for pressing lines 2 and 4 between cinching sheave members 41, 43, 45 and 47, respectively, so that the flow of lines 2 and 4 into housing 12 will be reduced and the descent of housing 12 along lines 2 and 4 will stop, it should be appreciated that the device may be biased toward a position which allows continuous flow of lines 2 and 4 into housing 12 without exceeding the scope of the present invention.

Sheave assembly 30 is disposed within the central portion of housing 12. Sheave assembly 30 includes stationary shaft 32, pivoting shaft 34, brackets 36 and two sets of tensioning members or sheaves 50 and 52. Tensioning sheave set 50 includes first member, or sheave 54 and second member, or sheave 53. Tensioning sheave set 52 includes first member, or sheave 56 and second member, or sheave 55. Mounts 38 firmly attach each end 33 of stationary shaft 32 to housing 12 by any suitable means, preferably screws 20. Stationary shaft 32 passes through holes 35 of brackets 36. Brackets 36 are thus suspended from stationary shaft 32 at holes 35. Brackets 36 may pivot relative to stationary shaft 32 at holes 35. Pivoting shaft 34 passes through holes 37 of brackets 36. Pivoting shaft 34 is thus disposed beneath stationary shaft 32 in a parallel spaced relationship relative to stationary shaft 32. Pivoting shaft 34 can also pivot relative to stationary shaft 32.

First sheaves 54 and 56, separated by mid-section 62, are mounted on stationary shaft 32 between each bracket 36. Second sheaves 53 and 55, separated by mid-section 64, are mounted on swinging shaft 34 between each bracket 36. After passing between cinching sheave pair 26 through entrance 14, line 2 is received by tensioning sheave set 50 where it rests in groove 70 of second sheave 53, then in groove 71 of first sheave 54, then spirals around to groove 72 of second sheave 53, then in groove 73 of first sheave 54, then spirals around again to groove 74 of second sheave 53, then to groove 75 of first sheave 54 and exits housing 12 through exit 16 between the pair of guide sheaves 22. Line 4 passes between cinching sheave pair 28 to enter housing 12 through entrance 14. Line 4 is received by tensioning sheave set 52 where it rests in groove 76 of second sheave 55, then in groove 77 of first sheave 56, then spirals around to groove 78 of second sheave 55, then rests in groove 79 of first sheave 56, then spirals around again to groove 80 of second sheave 55 then to groove 81 of first sheave 56, where it exits housing 12 through exit 16 between guide sheave pair 24. Thus, each set of tensioning sheaves 50 and 52 of sheave assembly 30, in structure and operation, is a mirror image of the other tensioning sheave set, 50 or 52. First sheaves 54 and 56 and mid-section 62 may be integral with each other or may be separate but closely aligned. Second sheaves 53 and 55 and mid-section 64 may be similarly related. Second sheaves 53 and 55 and first sheaves 54 and 56 are preferably integral with pivoting shaft 34 and stationary shaft 32 so that the flow of the lines 2 and 4 through the housing 12 imparts rotation to the sheaves 53, 55, 54 and 56 and to shafts 32 and 34. It should be appreciated, however, that other known means of translating the rotation of the sheaves 53 and 55 to pivoting shaft 34 may be used without exceeding the scope of the claimed invention. Brakes 40 and 42 are mounted on each end 39 of pivoting shaft 34 by nuts 44 or any other suitable known means. Brakes 40 and 42 move with pivoting shaft 34. Second sheaves 53 and 55 of sheave assembly 30 and the lower portions of brackets 36 are disposed between brake 40 and brake 42. The circumference of each brake 40 and 42 is greater than that of second sheaves 53 and 55, as shown in FIGS. 3 and 4.

In operation, as illustrated in FIG. 5, lines 2 and 4 are suspended from an elevated position. Housing 12 is disposed at the elevated position near the point of attachment of lines 2 and 4. The lines 2 and 4 should pass through entrance 14, spiral around tensioning sheave sets 50 and 52 as described above and pass through exit 16. Lines 2 and 4 should be sufficiently long to reach the ground or another suitable landing area. The person using device 10 should grasp ends 15 of housing 12. The weight of the user pulls housing 12 downward along lines 2 and 4. Lines 2 and 4 move through housing 12 and sheave assembly 30 at a steady rate as described above. Lines 2 and 4 impart rotation to sheaves 53 and 55, respectively, which in turn impart rotation to pivoting shaft 34. Lines 2 and 4 impart rotation to sheaves 54 and 56, respectively, which in turn impart rotation to stationary shaft 32. The weight of a person suspended from housing 12 exerts a gravitational pull on housing 12, which forces housing 12 to descend along lines 2 and 4. As housing 12 is urged downward, lines 2 and 4 pull pivoting shaft 34 and brackets 36 along an arcuate path, the radius of which is defined by the distance between the central axes of stationary shaft 32 and pivoting shaft 34. Because brakes 40 and 42 are so associated with pivoting shaft 34 that they move with it, pivoting shaft 34 imparts to brakes 40 and 42 the moment of the force pulling pivoting shaft 34 along the arcuate path at any point along that path. The moment can be described as a directional force along the radius of the arcuate path described above. As the brackets 36 and pivoting shaft 34 pivot through the arcuate path, the amount of the force changes as the angle formed by the radius of the arcuate path relative to the vertical increases. The angle formed by the radius of the arcuate path as described above would be O relative to the vertical when the brackets 36 lie along a vertical line. Vertical as used herein means vertical relative to the horizontal plane of the earth. As the brackets 36 pivot toward the interior surface 18 of housing 12 along the arcuate path, the angle formed by the radius relative to the vertical increases and the moment, in turn, changes. As will be more fully described below, the housing 12 is configured so that this angle and thus, the directional force or moment, reach a magnitude beyond which neither can go. A first mechanical advantage is thus imparted to brakes 40 and 42. The moment of force can be calculated by multiplying the weight which is suspended from the device by the tangent of the angle formed by the radius of pivot with the vertical. The first mechanical advantage is calculated by the inverse of the tangent of the angle.

As the lines 2 and 4 flow through housing 12 and spiral around tensioning sheaves 53, 54, 55 and 56, the sheaves 53, 54, 55 and 56 rotate in response to the flow of the lines. As stated above, the rotation of the sheaves 53, 54, 55 and 56 imparts rotation to shafts 32 and 34 and imparts a torque to brakes 40 and 42. A second mechanical advantage is thus imparted to brakes 40 and 42, the value of which ultimately depends on the rate of flow of lines 2 and 4 through housing 12, which in turn depends on the weight suspended from housing 12. The second mechanical advantage can be calculated by dividing the diameter of the brake 40 or 42 by the diameter of the grooves 70, 72, 74, 76, 78 and 80 over which the lines 2 and 4 flow.

Housing 12 is so configured that the brakes 40 and 42 engage the interior surface 18 of housing 12 at a point when pivoting shaft 34 and brackets 36 are pivoting through the arcuate path described above, thereby halting any further pivoting along the path. The moment of brakes 40 and 42 at that point reaches a magnitude beyond which it cannot go. The torque of brakes 40 and 42 at that point is preferably substantially equal to or marginally greater than the moment. In this relationship, the moment continuously urges brakes 40 and 42 against interior surface 18, while the torque continuously urges brakes 40 and 42 away from interior surface 18 so that the brakes 40 and 42 appear to vibrate against the interior surface 18 of housing 12. The torque thus counteracts and overcomes the moment so that the rotation and resulting descent of housing 12 may continue.

When the moment is greater than the torque, the torque ceases to urge brakes 40 and 42 away from the interior surface 18 so that the moment overcomes the torque, halting further rotation and thus stopping the descent of housing 12. By reducing the rate of flow of the lines 2 and 4 through housing 12, the torque of brakes 40 and 42 is reduced sufficiently relative to the moment of brakes 40 and 42 that the brakes 40 and 42 are forced against the interior surface 18 of housing 12 and are not urged away from interior surface 18. Rotation and the descent of housing 12 are thereby halted.

Control member 60 biases cinching sheave pair 26 and 28 toward a position for sufficiently reducing the flow of the lines 2 and 4 through housing 12 to stop the descent of housing 12. Control member 60 can be pressed, for example by the user's thumbs, to compress springs 84, to permit lines 2 and 4 to flow freely and steadily through housing 12 so that the torque is substantially equal to or marginally greater than the moment. In the preferred embodiment, where there are two sets of sheaves and brakes in a mirror image relationship to each other, the amount of force necessary to reduce the torque relative to the moment is slight.

By releasing control member 60 and thus, springs 84, the rate of flow of lines 2 and 4 into housing 12 via entrance 14 is reduced due to the action of cinching sheave members 41 and 45 and cinching sheave members 43 and 47 relative to lines 2 and 4, respectively. Since in the preferred embodiment brakes 40 and 42 are larger in diameter than second sheaves 53 and 55, brakes 40 and 42 reach interior surface 18 following a slight pivot by pivoting shaft 34 through its arcuate path. The brakes 40 and 42 halt the further rotation of sheaves 53 and 55 and, accordingly, halt the further descent of housing 12 along lines 2 and 4. The interior 18 of housing 12 acts as a brake drum against which brakes 40 and 42 interact. Brakes 40 and 42 do not bear against lines 2 and 4 at any time.

When the user grasps each end 15 of housing 12 the sheave assembly 30 is balanced. The mirror image arrangement of the sheave sets 50 and 52 and brakes 40 and 42 further helps to maintain the balance of device 10 during a descent. Because only a slight force is required to reduce the rate of flow of the lines 2 and 4, the device 10 is simple and easy to operate under emergency conditions.

As an example of the operative forces, suppose a weight of 200 lbs. is suspended from housing 12, the diameter of brakes 40 and 42 is 0.9375 inches and the diameter of grooves 70, 72, 74, 76, 78 and 80 is 0.625 inches and the resulting angle formed when the interior 18 of housing 12 halts the pivot of brakes 40 and 42 is 33°. The moment is derived by $F_1=(200\text{ lbs.})(\tan 33°)=129.88$. The first mechanical advantage is derived by $ma_1=1/\tan 33°=1.539$. The torque is derived by $F_2=(200\text{ lbs.})/ma_2$. The second mechanical advantage is derived by $ma_2=D/d=0.9375/0.625=1.5$. The torque, therefore, as defined by $F_2$ above, equals 133.33 lbs. The torque exceeds the moment by 3.45 lbs. Spring 84, therefore, must exert slightly more than 3.45 lbs. to maintian the reducing position where the torque is less than the moment. Accordingly, to move the control member 60 away from the reducing position, the user need only exert a force sufficient to permit the torque to substantially equal or marginally exceed the moment. It can be seen that by appropriately altering the variables, the desired operative forces can be achieved.

Lines 2 and 4 are preferably made of polypropylene. Stationary shaft 32 and swinging shaft 34 are preferably made of stainless steel. The tensioning sheaves 53, 54, 55, 56 and guide and cinching sheave pairs 22, 24 and 26, 28, respectively, are preferably made of aluminum. Brakes 40 and 42 are preferably made of rubber and housing 12 is preferably made of a transparent thermoplastic polycarbonate pipe. Although other materials may be used without exceeding the scope of the claimed invention, it can be seen that the preferred materials as well as the structure of the preferred embodiment provides a lightweight, compact yet durable personal lowering device having a fail safe braking design.

What is claimed is:

1. A personal lowering device which responds to the gravitational pull exerted by a weight placed thereon for use with at least one line suspended from an elevated position comprising:

a housing adapted to permit the line to so flow therethrough that said housing can descend along the line;

an assembly disposed within said housing for receiving and tensioning the line as the line flows through said housing, said assembly adapted to rotate in response to the flow of the line and adapted to pivot in response to the pull of the weight, said assembly having at least one set of members, said set adapted for so receiving the line that the line spirals around said set imparting rotation to said set as the line flows through said housing;

at least one brake so associated with said assembly that the pivot of said assembly imparts a moment to said brake and the rotation of said assembly imparts a torque to said brake;

said housing configured for such interaction with said brake that said housing can hold said moment to a predetermined magnitude and said torque can so counteract said moment that said housing descends when said torque is substantially equal to or greater than said moment and said housing stops when said torque is less than said moment;

said assembly comprising, a stationary shaft attached to said housing;

a pivoting shaft so connected to said stationary shaft that said pivoting shaft lies in a parallel spaced relationship relative to said stationary shaft and is adapted for pivoting motion relative to said stationary shaft;

means for connecting said pivoting shaft to said stationary shaft; and said set of members having a first member so mounted on said stationary shaft and a second member so mounted on said pivoting shaft that said set imparts rotation to said stationary and pivoting shafts, wherein said first and second members each have a plurality of annular grooves in which the line is received as the line flows through said housing.

2. A personal lowering device as recited in claim 1 wherein said first and second members each have three annular grooves.

3. A personal lowering device as recited in claim 1 for use with two lines wherein there are two sets of members, each of said sets adapted for receiving one of said lines.

4. A personal lowering device as recited in claim 3 for use with two lines wherein there are two brakes one of said brakes so mounted on each end of said pivoting shaft that said brakes moves with said pivoting shaft.

5. A personal lowering device as recited in claim 3 wherein said sets of members are in a mirror image relationship to each other.

6. A personal lowering device as recited in claim 1 wherein said brake is so mounted on said pivoting shaft that said brake moves with said pivoting shaft.

7. A personal lowering device as recited in claim 1 further comprising means for guiding the line as the line exits said housing.

8. A personal lowering device as recited in claim 7 wherein said guiding means is at least one pair of guide sheaves disposed on said housing adapted for receiving the line as the line exits said housing.

9. A personal lowering device as recited in claim 8 for use with two lines wherein there are two pairs of guide sheaves, each of said guide sheave pairs adapted to receive one of the lines therebetween.

10. A personal lowering device as recited in claim 1 further comprising:

means biased toward a position for reducing said torque relative to said moment, said reducing means adapted for movement away from said reducing position.

11. A personal lowering device as recited in claim 10 wherein said reducing means comprises:

at least one pair of cinching sheaves disposed on said housing adapted for receiving the line as the line enters said housing;

at least one spring for biasing said cinching sheave pair in said reducing position;

a control member associated with said cinching sheave pair and said spring for moving said cinching sheave pair away from said reducing position; and said reducing position being one in which said cinching sheave pair is positioned for so cinching the line that the rate of flow of the line through said housing is reduced.

12. A personal lowering device as recited in claim 11 for use with two lines wherein there are two pairs of cinching sheaves, each of said cinching sheave pairs adapted to receive one of the lines.

13. A personal lowering device as recited in claim 1 where said housing is configured for hand grasping.

14. A personal lowering device as recited in claim 1 further comprising apparatus suspended from said housing for carrying a person.

15. A personal lowering device which responds to the gravitational pull exerted by a weight placed thereon comprising:

at least two lines, each of said lines being adapted for suspension from an elevated position;

a housing through which said lines so flow that said housing can descend along said lines when the pull is exerted;

a sheave assembly disposed within said housing for receiving and tensioning said lines as said lines flow through said housing, said sheave assembly having a stationary shaft, a pivoting shaft so connectd to said stationary shaft that said pivoting shaft lies in a parallel spaced relationship relative to said stationary shaft and is adapted for pivoting motion relative to said stationary shaft in response to the pull of the weight, and at least two sets of sheaves disposed on each of said shafts around which said lines so spiral as said lines flow through said housing that said lines impart rotation to said sets of sheaves and said shafts;

at least one brake so associated with said pivoting shaft that the pivoting motion of said pivoting shaft imparts a moment to said brake and the rotation of said pivoting shaft imparts a torque to said brake; and said housing configured for such interaction with said brake that said housing can hold said moment to a predetermined magnitude and said torque can so counteract said moment that said housing descends when said torque is substantially equal to or greater than said moment and said housing stops when said torque is less than said moment.

16. A personal lowering device as recited in claim 15 wherein each of said sets of sheaves has a first sheave mounted on said stationary shaft and a second sheave mounted on said pivoting shaft.

17. A personal lowering device as recited in claim 18 further comprising means biased toward a position for reducing said torque relative to said moment, said reducing means being adapted for movement away from said reducing position.

18. A personal lowering device as recited in claim 17 wherein said reducing position is achieved by so cinching said lines that the rate of flow of said lines through said housing is reduced, thereby reducing the rotation imparted to said sheaves and said shafts.

* * * * *

UNITED STATES PATENT AND TRADEMARK OFFICE

CERTIFICATE OF CORRECTION

PATENT NO. : 4,567,962

DATED : February 4, 1986

INVENTOR(S) : Nicholas S. Kladitis

It is certified that error appears in the above—identified patent and that said Letters Patent is hereby corrected as shown below:

Col. 1, line 54, delete "and" and insert therefor --that--.

Signed and Sealed this

*Seventeenth* Day of *June 1986*

[SEAL]

*Attest:*

DONALD J. QUIGG

*Attesting Officer*

*Commissioner of Patents and Trademarks*